US007977858B2

(12) United States Patent
Hellebrekers et al.

(10) Patent No.: US 7,977,858 B2
(45) Date of Patent: Jul. 12, 2011

(54) LOW-PRESSURE MERCURY VAPOR DISCHARGE LAMP

(75) Inventors: Wim Hellebrekers, Eindhoven (NL); Lambert Christiaan Ida Kaldenhoven, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 166 days.

(21) Appl. No.: 12/374,808

(22) PCT Filed: Jul. 17, 2007

(86) PCT No.: PCT/IB2007/052849

§ 371 (c)(1), (2), (4) Date: Jan. 23, 2009

(87) PCT Pub. No.: WO2008/012729

PCT Pub. Date: Jan. 31, 2008

(65) Prior Publication Data

US 2010/0019651 A1 Jan. 28, 2010

(30) Foreign Application Priority Data

Jul. 27, 2006 (EP) ..... 06117941

(51) Int. Cl.
*H01J 1/62* (2006.01)

(52) U.S. Cl. ..... 313/490; 313/550

(58) Field of Classification Search ..... 313/490, 313/550

See application file for complete search history.

(56) References Cited

U.S. PATENT DOCUMENTS

| | | | | |
|---|---|---|---|---|
| 3,890,531 | A * | 6/1975 | Panofski et al. | 313/490 |
| 4,615,846 | A * | 10/1986 | Yoshino et al. | 264/13 |
| 5,767,617 | A * | 6/1998 | Wharmby et al. | 313/489 |
| 5,994,837 | A * | 11/1999 | Willems et al. | 313/550 |
| 6,404,122 | B1 | 6/2002 | Lankhorst et al. | |
| 6,417,615 | B1 * | 7/2002 | Yasuda et al. | 313/490 |
| 2008/0238291 | A1 * | 10/2008 | Nagasawa et al. | 313/490 |

FOREIGN PATENT DOCUMENTS

| | | | |
|---|---|---|---|
| CN | 1731557 | A | 2/2006 |
| CN | 1805109 | A | 7/2006 |
| EP | 0136866 | A2 | 4/1985 |
| EP | 1176627 | A2 | 1/2002 |
| JP | 59132555 | A | 7/1984 |

OTHER PUBLICATIONS

"Some new mercury alloys for use in fluorescent lamps"; Journal of the Illuminating Engineering Society, Apr. 1977, vol. 6, No. 3, pp. 141-147; Bloem et al.*

Database WPI Week 200723, Leadless Amalgam, Derwent Publications Ltd., London, GB; AN 2007-222670 XP002468731.

Database WPI Week 200644, Lead-free Medium Temperature Amalgam Comprises Silver, Bismuth Tin, Mercury and Indium, Derwent Publications Ltd., London, GB; AN 2006-425190 XP002468732.

* cited by examiner

*Primary Examiner* — Peter Macchiarolo

(57) ABSTRACT

A low-pressure mercury vapor discharge lamp is provided with a discharge vessel which encloses a discharge space including a filling of mercury and a rare gas in a gastight manner. The discharge vessel further includes an amalgam which communicates with the discharge space. The lamp has a discharge device for maintaining an electric discharge in the discharge vessel. The amalgam includes a bismuth-tin-indium compound having a bismuth (Bi) content in the range between 30≦Bi≦70 wt. %, a tin (Sn) content in the range between 25≦Sn≦67 wt. %, and an indium (In) content in the range between 3≦In ≦5 wt. %.

6 Claims, 7 Drawing Sheets

LOW-PRESSURE MERCURY VAPOR DISCHARGE LAMP

FIELD OF THE INVENTION

The invention relates to a low-pressure mercury vapor discharge lamp provided with a discharge vessel which encloses a discharge space comprising a filling of mercury and a rare gas in a gastight manner, said discharge vessel comprising an amalgam which communicates with the discharge space, and in which the low-pressure mercury vapor discharge lamp comprises discharge means for maintaining an electric discharge in the discharge vessel. The invention further relates to an amalgam for use in said low-pressure mercury vapor discharge lamp.

BACKGROUND OF THE INVENTION

Mercury constitutes the primary component for generating ultraviolet (UV) light in mercury vapor discharge lamps. A layer comprising a luminescent material, for example, a fluorescent powder, may be present on an inner wall of the discharge vessel for converting UV light to light having a different wavelength, for example, UV-B and UV-A for tanning purposes (sun panel lamps) or to visible radiation for general illumination purposes. Such discharge lamps are therefore also referred to as fluorescent lamps. The discharge vessel of a low-pressure mercury vapor discharge lamp is usually tubular and comprises both elongated and compact embodiments. Generally, the tubular discharge vessel of a compact fluorescent lamp has a collection of comparatively short straight parts of a comparatively small diameter, which straight parts are interconnected by means of bridge parts or via bent parts. Compact fluorescent lamps are usually provided with an (integrated) lamp base. In such embodiments of the low-pressure mercury vapor discharge lamp, the discharge vessel comprises electrodes for maintaining a discharge inside the discharge vessel during operation of the lamp. Alternatively, in electrodeless mercury vapor discharge lamps, electric energy is inductively or capacitively coupled into the discharge space.

The term "nominal operation" in the description of the present invention is used for indicating operating conditions in which the mercury vapor pressure in the discharge vessel is such that the lamp has a radiation output of at least 80% of the output during optimum operation, i.e. under operating conditions in which the mercury vapor pressure is optimal. Furthermore, the term "initial radiation output" in the description is defined as the radiation output of the discharge lamp one second after switching on the discharge lamp, and the "run-up time" is defined as the time required by the discharge lamp to achieve a radiation output of 80% of the output during optimum operation.

A low-pressure mercury vapor discharge lamp as described in the opening paragraph, hereinafter also referred to as vapor pressure-controlled lamp, is known from EP 0 136 866 B1. As compared with the discharge lamp containing only free mercury, an amalgam limits the mercury vapor pressure in the discharge vessel. This renders nominal operation of the lamp possible at comparatively high lamp temperatures such as may occur in the case of a high lamp load, or when the lamp is used in a closed or poorly ventilated luminaire. The amalgam comprises mercury and at least one low melting point metal selected from tin, lead, bismuth and indium.

In addition to the mercury vapor discharge lamp according to the prior art, lamps are known which do not only comprise a (main) amalgam, but also an auxiliary amalgam. Provided that the auxiliary amalgam contains sufficient mercury, the lamp will have a comparatively short run-up time. Upon switching on the lamp, the auxiliary amalgam is heated by the electrode so that it evolves a substantial portion of the mercury present therein comparatively quickly. It is desirable that the lamp should be out of operation for a sufficiently long time before it is switched on, so that the auxiliary amalgam is able to take up sufficient mercury. When the lamp has been out of operation for a relatively short period, the shortening effect on the run-up time is only weak. Furthermore, a drawback especially arises in long lamps for which relatively much time is required before the mercury evolved by the auxiliary amalgam has spread over the entire discharge vessel, so that such lamps show a bright zone near the auxiliary amalgam and a darker zone remote from the auxiliary amalgam during a period of a few minutes after switching on.

In addition, low-pressure mercury vapor discharge lamps are known which are not provided with an amalgam and contain exclusively free mercury. These lamps, hereinafter also referred to as mercury lamps, have the advantage that the mercury vapor pressure at room temperature and hence the initial radiation output are comparatively high. Moreover, the run-up time is relatively short. Furthermore, lamps of this type, which have a relatively long discharge vessel, have a substantially constant brightness throughout their length after switching on, because the mercury vapor pressure (at room temperature) is sufficiently high upon switching on. Nominal operation at comparatively high lamp temperatures can be achieved with a mercury lamp whose discharge space contains just enough mercury to establish a mercury vapor pressure at the operating temperature that is close to the optimum mercury vapor pressure. During the lifetime of the lamp, however, mercury is lost because this is bound, for example, on a wall of the discharge vessel and/or by emitter material. Consequently, in practice, such a lamp has only a limited lifetime. In mercury lamps, a quantity of mercury is therefore dosed which is considerably higher than the quantity required in the vapor phase during nominal operation. However, this has the drawback that the mercury vapor pressure is equal to the vapor saturation pressure associated with the temperature of the coldest spot in the discharge vessel. Since the vapor saturation pressure rises exponentially with the temperature, temperature variations that occur, for example, in a poorly ventilated luminaire or in the case of a high lamp load, lead to a decrease of the radiation output. At comparatively low ambient temperatures, the mercury vapor pressure decreases, which also leads to a decrease of the radiation output.

When reducing the input power of a vapor-controlled lamp for dimming the light output of the lamp, the operating temperature of the lamp decreases. Hence, the temperature of the amalgam decreases as well. During the time a mercury vapor discharge lamp with a Bi—In—Hg amalgam according to the prior art cools down, the amalgam enters a temperature region wherein the mercury vapor pressures drops significantly, which results in a corresponding decrease of the light output of the lamp. In addition, a shift in the color temperature of the light generated by the lamp may occur. These phenomena are especially detrimental when a mercury vapor discharge lamp is used for Liquid Crystal Display (LCD) backlighting, in which lamps may be dimmed in order to improve the picture quality, for example, during scanning operation of the lamps in order to reduce motion blur effects. A significant drop in the light output and a possible change of the color temperature of the light strongly reduce the picture quality.

OBJECT AND SUMMARY OF THE INVENTION

It is an object of the invention to provide a low-pressure mercury vapor discharge lamp that at least partially solves the above-mentioned problem.

This object is achieved with a low-pressure mercury vapor discharge lamp according to the invention characterized in that the amalgam comprises a bismuth-tin-indium compound having a bismuth (Bi) content in the range 30≦Bi≦70 wt. %, a tin (Sn) content in the range 25≦Sn≦67 wt. %, and an indium (In) content in the range 3≦In≦5 wt. %. For a low-pressure mercury vapor discharge lamp with an amalgam according to the invention, the mercury vapor pressure does not significantly decrease during dimming of the lamp, i.e. cooling down of the amalgam, within a certain temperature region of the amalgam. Hence, in this temperature region of the amalgam, the light output of the lamp does not significantly decrease, allowing dimming of the lamp in a more controlled manner within a relatively wide range of operating temperatures.

A preferred embodiment of the low-pressure mercury vapor discharge lamp according to the invention is characterized in that the indium content is in the range 3≦In≦4 wt. %. Another preferred embodiment of the low-pressure mercury vapor discharge lamp according to the invention is characterized in that the indium content is in the range 3≦In≦3.5 wt. %. These embodiments have the advantage that dimming of the lamp in a more controlled manner is even further improved.

A preferred embodiment of the low-pressure mercury vapor discharge lamp according to the invention is characterized in that the amalgam comprises a bismuth-tin-indium (Bi—Sn—In) compound in the range 97.5≦Bi—Sn—In≦99.5 wt. % and mercury (Hg) in the range 0.5≦Hg≦2.5 wt. %, allowing nominal operation of the lamp within a relatively wide temperature range.

A preferred embodiment of the low-pressure mercury vapor discharge lamp according to the invention is characterized in that the amalgam comprises a bismuth-tin-indium (Bi—Sn—In) compound in the range 99≦Bi—Sn—In≦99.5 wt. % and mercury (Hg) in the range 0.5≦Hg≦1 wt. %, resulting in a reduction of the amount of mercury in the amalgam while maintaining nominal operation of the lamp within a relatively wide temperature range.

BRIEF DESCRIPTION OF THE DRAWINGS

FIGS. 1 to 3 are purely diagrammatic and not drawn to scale. Notably, some dimensions are shown strongly exaggerated for the sake of clarity. Similar components in the Figures are denoted as much as possible by the same reference numerals.

DESCRIPTION OF EMBODIMENTS

Figure 1A:
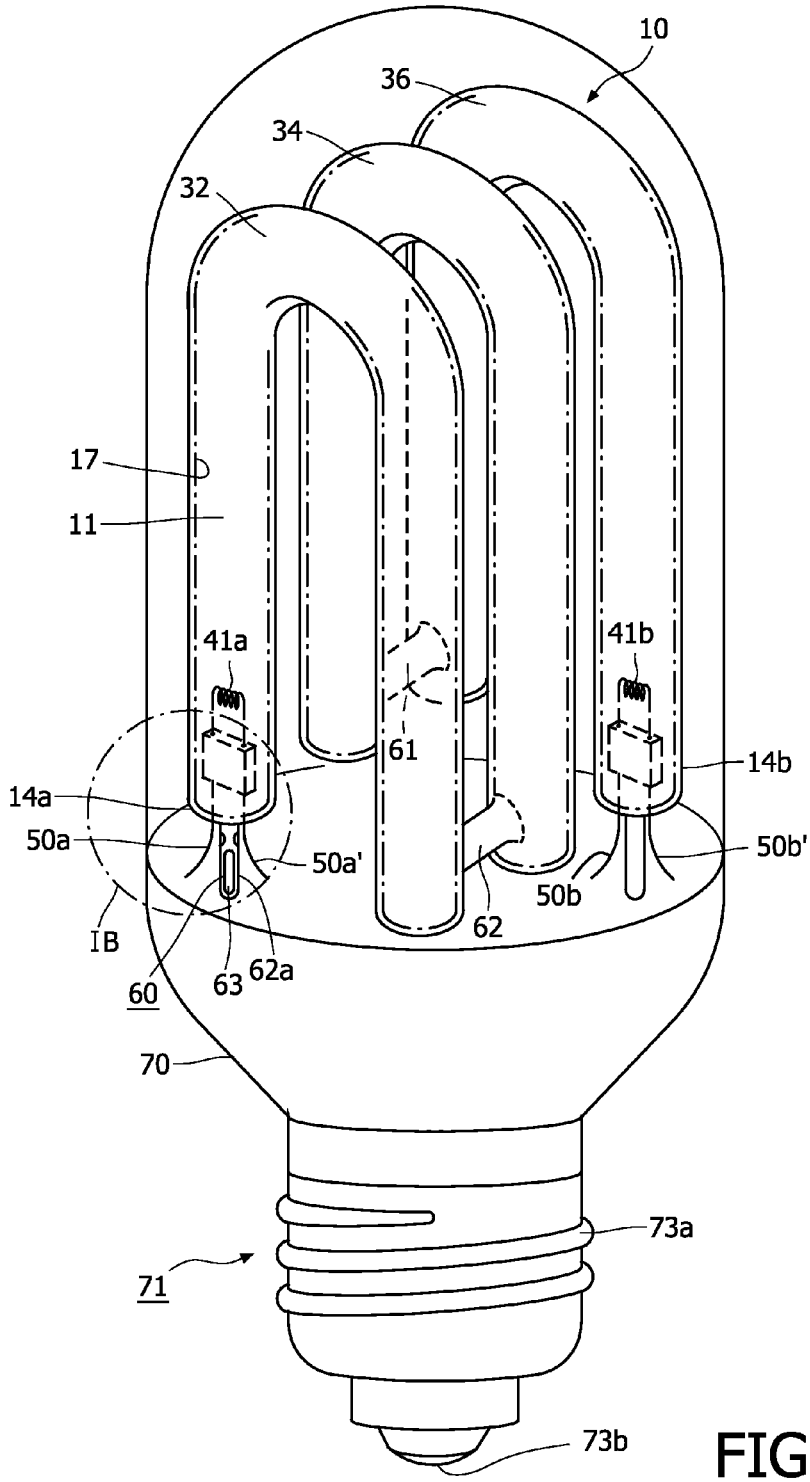
FIG. 1A is a perspective elevational view of a first embodiment of a low-pressure mercury vapor discharge lamp according to the invention.
Figure 1B:
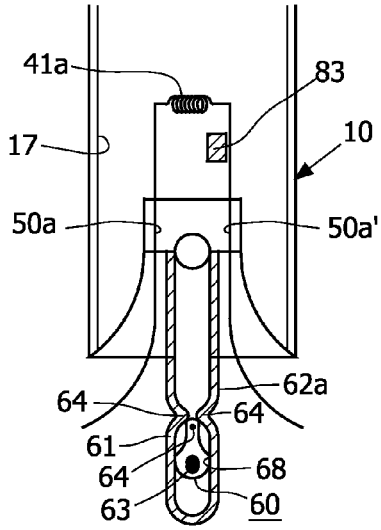
FIG. 1B shows a detail of the lamp shown in FIG. 1A in accordance with 1B in a side-elevational view.

FIG. 1A is a perspective elevational view of an embodiment of a low-pressure mercury vapor discharge lamp comprising a radiation-transmissive discharge vessel 10 which encloses a discharge space 11 having a volume of approximately 30 $cm^3$ in a gastight manner. In this case, the discharge vessel 10 comprises a mixture of 75% by volume of argon and 25% by volume of neon, with a filling pressure of 400 Pa. In this embodiment, the discharge vessel 10 is formed from a light-transmissive tubular portion of lime glass having three U-shaped segments 32, 34, 36 with an overall length of approximately 46 cm, an outer diameter of 11 mm and an inner diameter of 10 mm. The discharge vessel 10 is sealed by end portions 14*a*; 14*b*. The segments 32, 34, 36 are interconnected by (tubular) ducts 61, 62. The tubular portion has a luminescent coating 17 on an internal surface. Means for maintaining a discharge are constituted by an electrode pair 41*a*; 41*b* arranged in the discharge space 11. The electrode pair 41*a*; 41*b* is a winding of tungsten coated with an electron-emissive material (emitter material), in this case a mixture of barium, calcium and strontium oxide. Each electrode 41*a*; 41*b* is supported by an end portion 14*a*; 14*b* of the discharge vessel 10. Current supply conductors 50*a*, 50*a*'; 50*b*, 50*b*' project from the electrode pairs 41*a*; 41*b* through the end portions 14*a*; 14*b* of the discharge vessel 10. The current supply conductors 50*a*, 50*a*', 50*b*, 50*b*' are connected to a power supply (not shown) incorporated in the housing 70 and electrically connected to known electric and mechanical contacts 73*a*, 73*b* on the lamp base 71. In addition to the rare gas mixture, the discharge space 11 comprises mercury. The discharge space 11 further comprises a capsule 60 with an amalgam 63; see also FIG. 1B in which a detail of FIG. 1A in accordance with 1B is shown in a side-elevational view. To this end, the capsule 60 with a wall 61 of lime glass comprising 4.0% by weight of FeO is arranged in the discharge vessel 10, in this case in a tubular protuberance 62*a*. In operation, the amalgam 63 communicates with the discharge vessel 10 via an aperture 64 melted in the wall 61 of the capsule 60. The capsule 60 has a domed portion 68 with which it is clamped into the protuberance 62*a*.

Optionally, one of the current supply conductors 50*a*' may be further provided with an auxiliary amalgam 83. When the mercury vapor discharge lamp is switched on, the auxiliary amalgam 83 is heated by the electrode 41*a* so that it evolves a substantial part of the mercury therein at a relatively fast rate, which results in a comparatively short run-up time. In an alternative embodiment of the low-pressure mercury vapor discharge lamp, the amalgam 63 is dosed without a capsule 60, but uses a glass rod instead to prevent the amalgam from reaching the discharge vessel.

Figure 2:
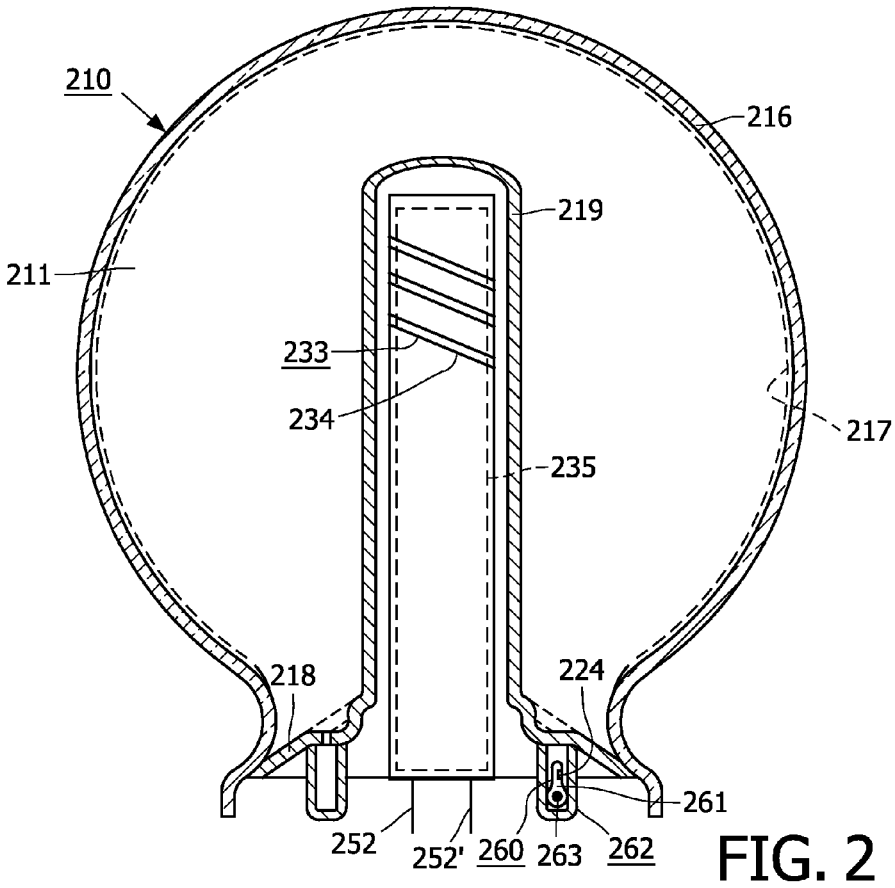
FIG. 2 shows a second embodiment of a low-pressure mercury vapor discharge lamp according to the invention.

FIG. 2 shows an alternative embodiment of a low-pressure mercury vapor discharge lamp according to the invention. Components corresponding to those in FIG. 1A have a reference numeral increased by 200. The discharge vessel 210 has a pear-shaped enveloping portion 216 and a tubular invaginated portion 219 which is connected to the enveloping portion 216 via a flared portion 218. A capsule 260 comprising an amalgam 263 is positioned in a protuberance 262 on the flared portion 218 of the discharge vessel 210. In operation, the amalgam 263 communicates with the discharge vessel 210 via an aperture (not shown) melted in the wall 261 of the capsule 260. The invaginated portion 219, outside a discharge space 211 surrounded by the discharge vessel 210, accommodates a coil 233 which has a winding 234 of an electric conductor constituting means for maintaining an electric discharge in the discharge space 211. During operation, the coil 233 is fed via current supply conductors 252, 252' with a high-frequency voltage, i.e. a frequency of approximately 20 kHz or more, typically 3 MHz. The coil 233 surrounds a core 235 of a soft-magnetic material (shown in broken lines). Alternatively, the core may be omitted. In an alternative embodiment, the coil 233 is arranged inside the discharge space 211. In operation, the amalgam 263 communicates with the discharge vessel 210 via an aperture melted in the wall 261 of the capsule 260.

Figure 3:
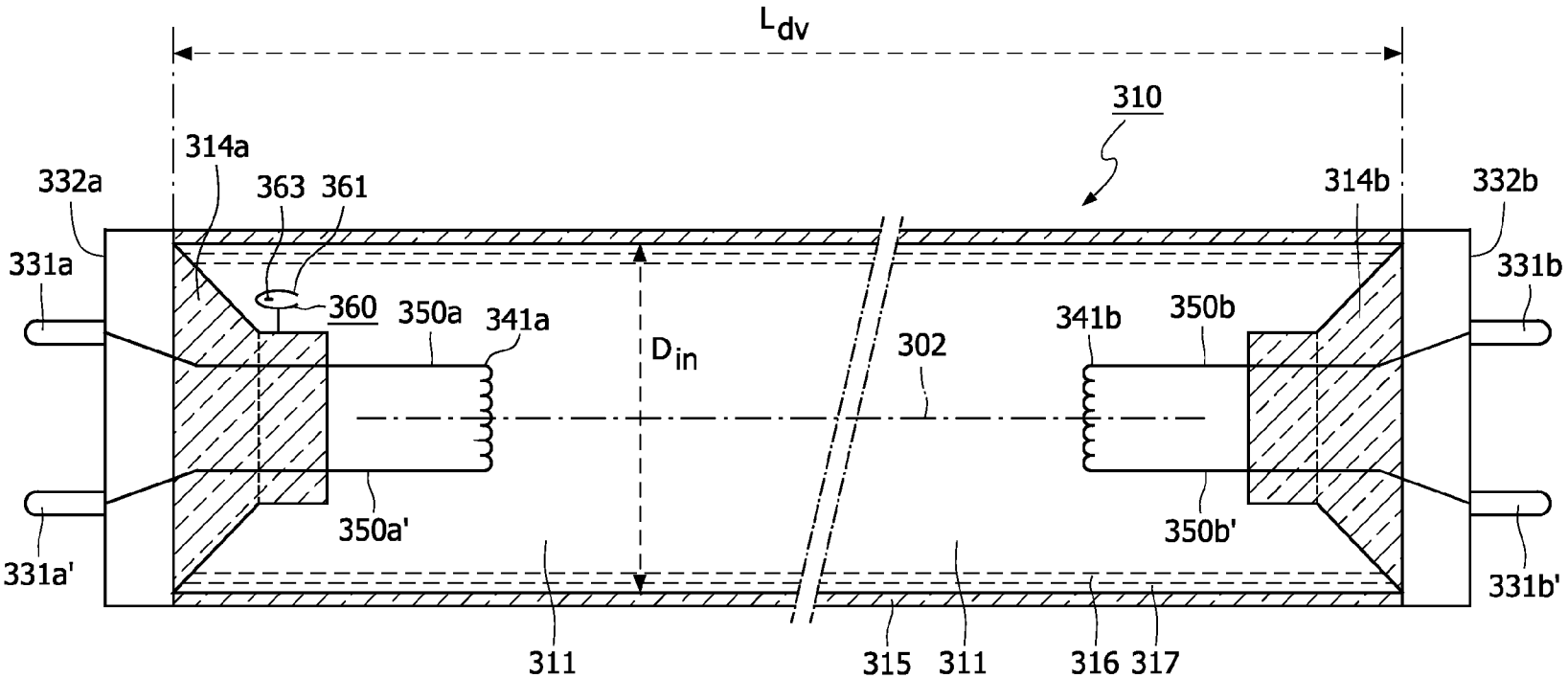
FIG. 3 shows a third embodiment of a low-pressure mercury vapor discharge lamp according to the invention.

FIG. 3 shows a further alternative embodiment of a low-pressure mercury vapor discharge lamp according to the invention. Components corresponding to those in FIG. 1A have a reference numeral increased by 300. The lamp has a glass discharge vessel 310 with a tubular portion 315 about a longitudinal axis 302, enclosing a discharge space 311. The discharge vessel 310 transmits radiation generated in the discharge space 311 and is provided with a first and a second end portion 314*a*; 314*b*, respectively. The discharge vessel 310 encloses, in a gastight manner, the discharge space 311 containing a filling of mercury and an inert gas mixture comprising, for example, argon. In the example of FIG. 3, the side of the tubular portion 315 facing the discharge space 311 is coated with a protective layer 316. In an alternative embodiment, the first and second end portions 314*a*, 314*b* are also coated with a protective layer. In fluorescent discharge lamps, the side of the tubular portion 315 facing the discharge space 311 is additionally coated with a luminescent layer 317. In the example of FIG. 3, means for maintaining a discharge in the discharge space 311 are electrodes 341*a*; 341*b* arranged in the discharge space 311, which electrodes 341*a*; 341*b* are supported by the end portions 314*a*; 314*b*. The electrode 341*a*; 341*b* is a winding of tungsten covered with an electron-emitting substance, in this case a mixture of barium oxide, calcium oxide and strontium oxide. Current-supply conductors 350*a*, 350*a*'; 350*b*, 350*b*' are connected to contact pins 331*a*, 331*a*'; 331*b*, 330*b*' secured to lamp caps 332*a*, 332*b*, respectively. Optionally, an electrode ring, not shown in FIG. 3, is arranged around each electrode 341*a*; 341*b*, on which ring a glass capsule for proportioning mercury is clamped. In operation, an amalgam 363 communicates with the discharge vessel 310 via an aperture melted in the wall 361 of a capsule 360. The capsule 360 is mounted to the end portion 314*a*. In an alternative embodiment, the capsule 360 is positioned inside an exhaust tube (not shown in FIG. 3) in the end portion 314*a* which is used during production of the lamp for cleaning and filling of the lamp, and closed afterwards.

The amalgam 63, 263, 363 is an amalgam according to the invention comprising a bismuth (Bi)— tin (Sn)— indium (In) compound; in the embodiments shown a quantity of 100 mg of an amalgam of Hg with an alloy of bismuth, tin and indium, with a bismuth content in the range between 30≦Bi≦70 wt. %, a tin content in the range between 25≦Sn≦67 wt. %, and an indium content in the range between 3≦In≦5 wt. %. A preferred composition of the Bi—Sn—In alloy is a bismuth content in the range between 30≦Bi≦70 wt. %, a tin content in the range between 25≦Sn≦67 wt. %, and an indium content in the range between 3≦In≦4 wt. %. A more preferred composition of the Bi—Sn—In alloy is a bismuth content in the range between 30≦Bi≦70 wt. %, a tin content in the range between 25≦Sn≦67 wt. %, and an indium content in the range between 3≦In≦3.5 wt. %. The amalgam 63, 263, 363 comprises a bismuth-tin-indium compound (Bi—In—Sn) in the range between 97.5≦Bi—In—Sn≦99.5 wt. % and mercury (Hg) in the range between 0.5≦Hg≦2.5 wt. %. The amalgam 63, 263, 363 preferably comprises a bismuth-tin-indium compound (Bi—In—Sn) in the range between 99≦Bi—In—Sn≦99.5 wt. % and mercury (Hg) in the range between 0.5≦Hg≦1 wt. %.

Figure 4:
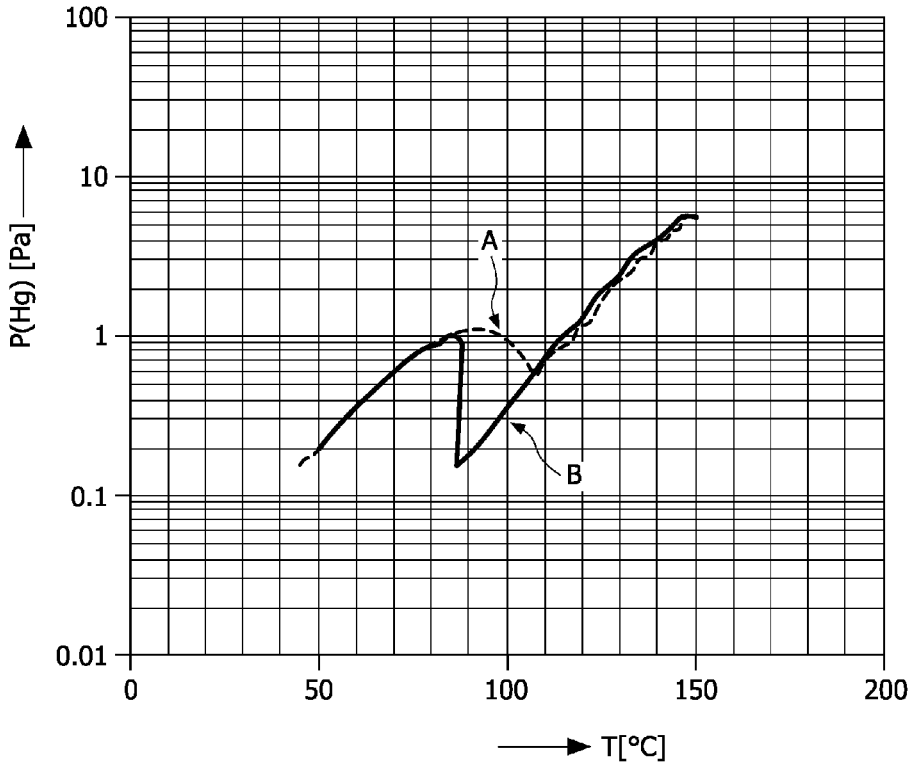
FIG. 4 shows the mercury vapor pressure as a function of the amalgam temperature for a Bi—In—Hg amalgam according to the prior art, during heating up and cooling down of the amalgam.

FIG. 4 shows the mercury vapor pressure ($p_{Hg}$ expressed in Pa) as a function of the amalgam temperature (T expressed in degrees Celsius) for a Bi—In—Hg amalgam according to the prior art. The amalgam comprises a bismuth-indium alloy with a content of 97 wt. % and mercury with a content of 3 wt. %. The bismuth-indium alloy has a bismuth content of 71 wt. % and an indium content of 29 wt. %. Curve A shows the mercury vapor pressure as a function of the amalgam temperature during heating up of the amalgam, and curve B shows the mercury vapor pressure as a function of the amalgam temperature during cooling down of the amalgam. Typically, when dimming a lamp with an amalgam from 100% light output to 20% light output, the temperature of the amalgam decreases from 120° C. to 60° C. Nominal operation of the lamp is achieved for mercury vapor pressures in the range between 0.5 Pa and 5 Pa. As can be seen from curve B, when the temperature of the amalgam decreases, at a temperature of approximately 105° C., the mercury vapor pressure becomes lower as compared to that denoted by curve A. The difference between the mercury vapor pressure denoted by curves B and A increases at a decreasing amalgam temperature until a temperature of approximately 85° C. is reached. From that point downwards, the mercury vapor pressures denoted by curves A and B become comparable again. At a temperature of approximately 85° C., the mercury vapor pressure denoted by curve B is roughly a factor of seven smaller as compared to that denoted by curve A. This significant decrease of the mercury vapor pressure during cooling down of the amalgam, as compared to the mercury vapor pressure during heating up of the amalgam (curve A), results in a significant decrease of the light output of the lamp during dimming of the lamp.

Figure 5:
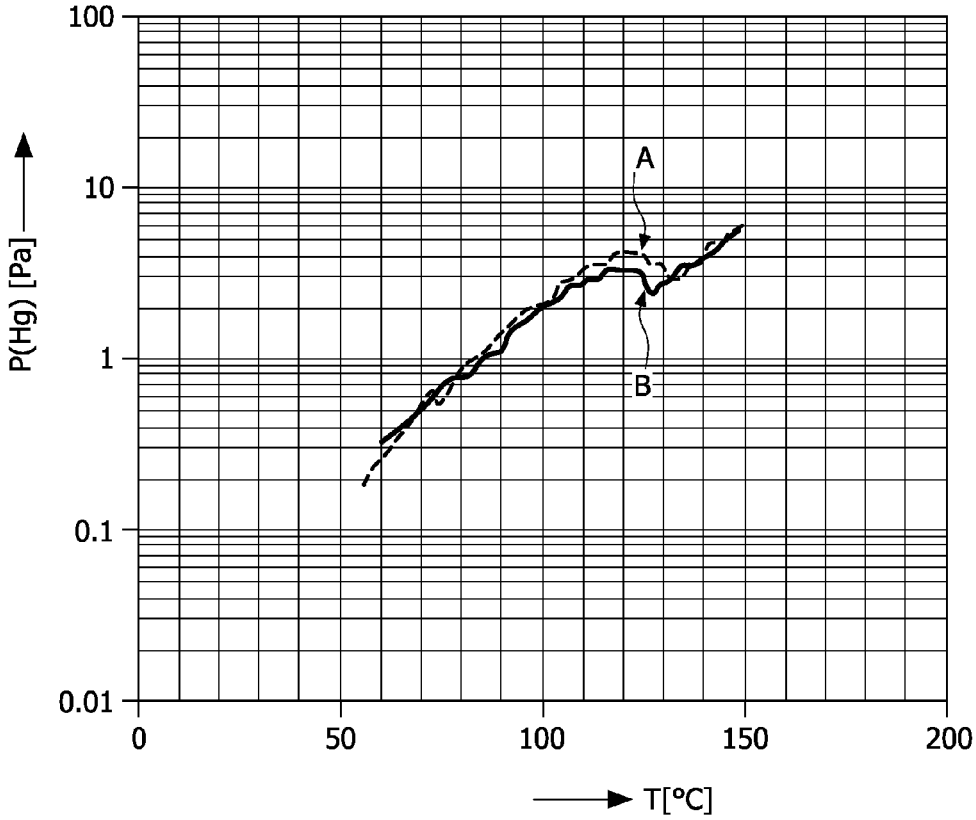
FIG. 5 shows the mercury vapor pressure as a function of the amalgam temperature for a first embodiment of an amalgam according to the invention, comprising a Bi—Sn—In compound, during heating up and cooling down of the amalgam.

FIG. 5 shows the mercury vapor pressure ($p_{Hg}$ expressed in Pa) as a function of the amalgam temperature (T expressed in degrees Celsius) for a first embodiment of an amalgam according to the invention comprising a Bi—Sn—In compound, during heating up and cooling down of the amalgam. The amalgam comprises a bismuth-tin-indium alloy with a content of 99 wt. % and mercury with a content of 1 wt. %. The bismuth-tin-indium alloy has a bismuth content of 40 wt. %, a tin content of 57 wt. % and an indium content of 3 wt. %.

Figure 6:
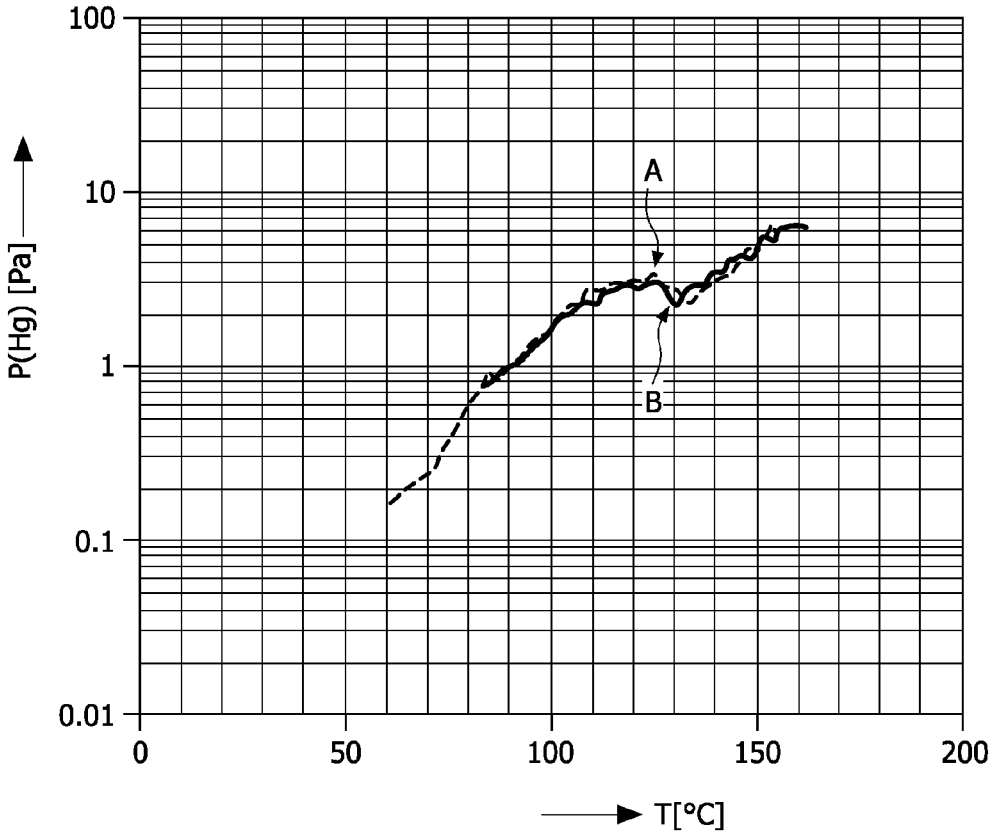
FIG. 6 shows the mercury vapor pressure as a function of the amalgam temperature for a second embodiment of an amalgam according to the invention, comprising a Bi—Sn—In compound, during heating up and cooling down of the amalgam.

FIG. 6 shows the mercury vapor pressure ($p_{Hg}$ expressed in Pa) as a function of the amalgam temperature (T in degrees Celsius) for a second embodiment of a Bi—Sn—In amalgam according to the invention, during heating up and cooling down of the amalgam. The amalgam comprises a bismuth-tin-indium alloy with a content of 99 wt. % and mercury with a content of 1 wt. %. The bismuth-tin-indium alloy has a bismuth content of 70 wt. %, a tin content of 27 wt. % and an indium content of 3 wt. %. Referring to FIGS. 5 and 6, Curve A shows the mercury vapor pressure as a function of the amalgam temperature during heating up of the amalgam, and curve B shows the mercury vapor pressure as a function of the amalgam temperature during cooling down of the amalgam. As can be seen from FIGS. 5 and 6, the mercury vapor pressure as a function of the temperature during cooling down of the amalgam is comparable to that during heating up of the amalgam. Hence, during dimming of the lamp, there is no significant decrease of the mercury vapor pressure and therefore no significant decrease of the light output of the lamp within a certain temperature region, as compared to the mercury vapor pressure during heating up of the amalgam.

Figure 7:
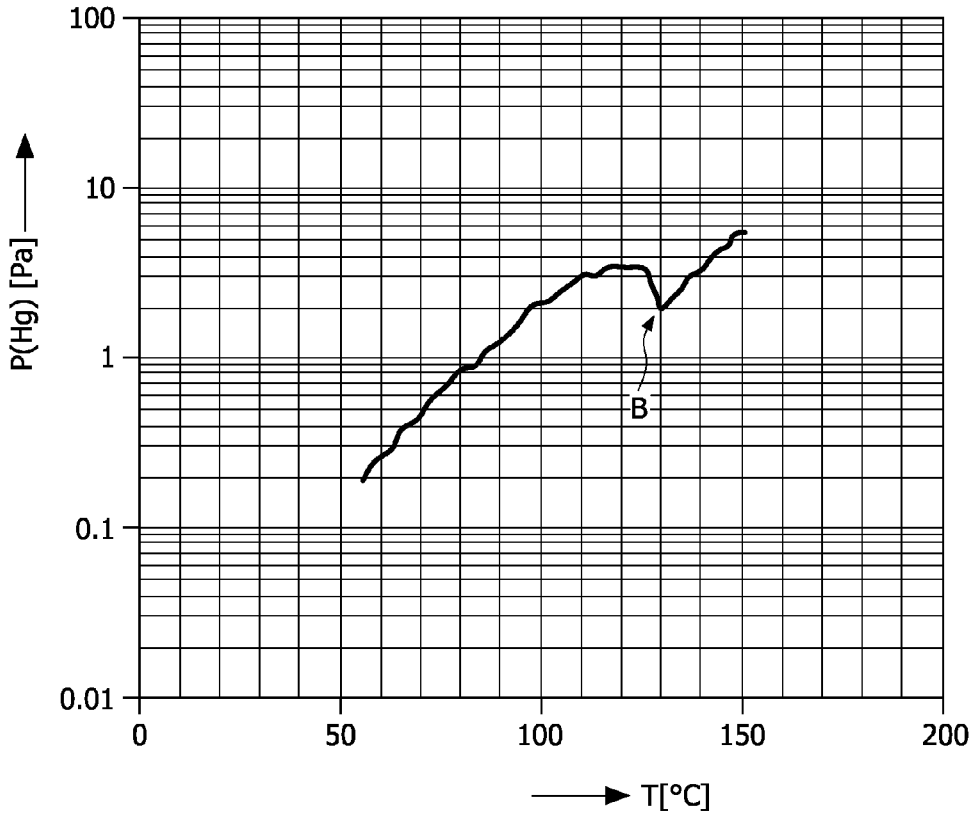
FIG. 7 shows the mercury vapor pressure as a function of the amalgam temperature for a third embodiment of an amalgam according to the invention, comprising a Bi—Sn—In compound during cooling down of the amalgam.

FIG. 7 shows the mercury vapor pressure ($p_{Hg}$ expressed in Pa) as a function of the amalgam temperature (T expressed in degrees Celsius) for a third embodiment of a Bi—Sn—In amalgam according to the invention, only during cooling down of the amalgam. The amalgam comprises a bismuth-tin-indium alloy with a content of 99 wt. % and mercury with a content of 1 wt. %. The bismuth-tin-indium alloy has a bismuth content of 55 wt. %, a tin content of 42 wt. % and an indium content of 3 wt. %. The shape of Curve B is identical to that in FIGS. 5 and 6, i.e. no significant decrease of the mercury vapor pressure within a certain temperature region of the amalgam is observed. Hence, during dimming of the lamp, there is no significant decrease of the mercury vapor pressure and therefore no significant decrease of the light output of the lamp within a certain temperature region, as compared to the mercury vapor pressure during heating up of the amalgam.

An amalgam according to the invention comprising a bismuth-tin-indium compound having a bismuth (Bi) content in the range between 30≦Bi≦70 wt. %, a tin (Sn) content in the range between 25≦Sn≦67 wt. %, and an indium (In) content in the range between 3≦In≦5 wt. % allows a more controlled dimming of a low-pressure mercury vapor discharge lamp because the mercury vapor pressure during cooling down of the amalgam is comparable to that during heating up of the amalgam. The controlled dimming is especially advantageous when a low-pressure mercury vapor discharge lamp according to the invention is used for backlighting an LCD, in which lamps may be dimmed in order to improve the picture quality. A significant drop in the light output within a certain temperature region of the amalgam during cooling down would strongly reduce the resulting picture quality.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. Use of the article "a" or "an" preceding an element does not exclude the presence of a plurality of such elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A low-pressure mercury vapor discharge lamp provided with a discharge vessel which encloses a discharge space comprising a filling of mercury and a rare gas in a gastight manner, said discharge vessel comprising an amalgam which communicates with the discharge space, and in which the low-pressure mercury vapor discharge lamp comprises discharge device for maintaining an electric discharge in the discharge vessel, wherein the amalgam comprises a bismuth-tin-indium compound having a bismuth (Bi) content in the range 30≦Bi≦70 wt. %, a tin (Sn) content in the range 58≦Sn≦67 wt. %, and an indium (In) content in the range 3≦In≦5 wt. %.

2. A low-pressure mercury vapor discharge lamp as claimed in claim 1, characterized in that the indium content is in the range 3≦In<4 wt. %.

3. A low-pressure mercury vapor discharge lamp as claimed in claim 1, characterized in that the indium content is in the range 3≦In≦3.5 wt. %.

4. The low-pressure mercury vapor discharge lamp as claimed in claim 1, wherein the amalgam comprises a bismuth-tin-indium (Bi—Sn—In) compound in the range 97.5≦Bi—Sn—In≦99.5 wt. % and mercury (Hg) in the range 0.5≦Hg≦2.5 wt. %.

5. The low-pressure mercury vapor discharge lamp as claimed in claim 1, wherein the amalgam comprises a bismuth-tin-indium compound (Bi—Sn—In) in the range 99≦Bi—Sn—In≦99.5 wt. % and mercury (Hg) in the range 0.5≦Hg≦1 wt. %.

6. An amalgam comprising a bismuth-tin-indium compound having a composition as claimed in claim 1.

* * * * *